US007458566B2

(12) United States Patent
Rygol

(10) Patent No.: US 7,458,566 B2
(45) Date of Patent: Dec. 2, 2008

(54) BOOK BLOCK CLAMP

(75) Inventor: Dirk Rygol, Osnabrück (DE)

(73) Assignee: Kolbus GmbH & Co. KG, Rahden (DE)

( * ) Notice: Subject to any disclaimer, the term of this patent is extended or adjusted under 35 U.S.C. 154(b) by 276 days.

(21) Appl. No.: 11/342,072

(22) Filed: Jan. 27, 2006

(65) Prior Publication Data

US 2006/0177286 A1 Aug. 10, 2006

(30) Foreign Application Priority Data

Feb. 8, 2005 (DE) ..... 10 2005 005 652

(51) Int. Cl.
*B65H 39/00* (2006.01)

(52) U.S. Cl. ..... 270/52.16; 270/52.25

(58) Field of Classification Search ..... 270/52.16; 412/9, 10, 18, 25, 33; 198/644
See application file for complete search history.

(56) References Cited

U.S. PATENT DOCUMENTS

| | | | | |
|---|---|---|---|---|
| 3,669,246 A | | 6/1972 | Risi | |
| 4,231,466 A | * | 11/1980 | Rathert | 198/803.7 |
| 4,467,912 A | * | 8/1984 | Rathert | 198/803.7 |
| 4,507,036 A | | 3/1985 | Rathert | |
| 5,788,446 A | * | 8/1998 | Stolz | 412/9 |

FOREIGN PATENT DOCUMENTS

| | | |
|---|---|---|
| DE | OS 21 10 836 | 10/1971 |
| DE | 32 07 102 C2 | 9/1983 |
| DE | 41 02 552 A1 | 9/1991 |

* cited by examiner

*Primary Examiner*—Gene O. Crawford
*Assistant Examiner*—Leslie A Nicholson, III
(74) *Attorney, Agent, or Firm*—Alix, Yale & Ristas, LLP

(57) ABSTRACT

The invention relates to a book block clamp (1) for clamping and transporting book blocks (2) in book block processing machines, comprising an inner clamping jaw (5) and comprising an outer clamping jaw (6) which is arranged parallel to, and movable in relation to, said inner clamping jaw (5). A support element (20) is associated with the outer clamping jaw (6), which support element (20) can be moved into a position that is spaced apart in parallel in relation to the outer clamping jaw (6), as a result of which the opening width of the book block clamp (1) is reduced, while the distance between the inner and the outer clamping jaw (5, 6) remains unchanged. By separately controlling the opening width, reliable and impeccable guidance, in particular of unstable layers and/or folded sections of unbound book blocks (2), becomes possible, while the opening- and/or closing movement of the outer clamping jaw (6) continues to be controlled by way of a fixed greater actuating stroke, and is thus free of any jerking or jolting.

21 Claims, 2 Drawing Sheets

BOOK BLOCK CLAMP

BACKGROUND OF THE INVENTION

The present invention relates to a book block clamp for clamping and transporting book blocks in book block processing machines.

Book block processing machines have a transport system which comprises a multitude of book block clamps that are continuously movable in a closed circulation path and that are arranged at equal mutual spacing from each other. Such book block clamps move in a guideway and are connected to a transport chain that provides the driving force. The outer clamping jaw of the book block clamps can be slid horizontally and at a right angle to the direction of movement of the book block clamp, wherein the book block clamps are controllable between a closed position for clamping, and an open position for infeed or delivery of the book block.

A book block clamp of this type is for example shown in DE-OS 21 10 836. At the ends of its outer clamping jaw the book block clamp comprises toothed racks that are slidable along the longitudinal axis in the inner clamping jaw, and which engage pinions on the end of an arbor which is held in the inner clamping jaw so as to be parallel to the outer clamping jaw. Behind the inner clamping jaw the two toothed racks are brought together by a bar which causes the movement for opening and closing by running on a cam roller. By way of a torsion spring that is seated on the parallel arbor, wherein one end of the torsion spring is connected to the inner clamping jaw, the clamping force required for holding the book block is generated. Starting with pretensioning, the torsion spring tensions as the distance between the clamping jaws increases, and consequently an effective clamping force of the book block clamp is generated depending on the block thickness. It is not possible to exert a defined clamping force that is independent of the block thickness. Finally, to hold the open position of the clamping device, a reverse drive lock in the form of a further coil spring arranged on the arbor is provided.

DE 32 07 102 C2 discloses another book block clamp which provides for clamping jaws that are guided in parallel. Its outer clamping jaw is guided so as to be freely slidable on a guide rod by way of a slide guide, wherein the guide rod is located on one side of the inner clamping jaw. The outer clamping jaw itself comprises a clamping plate, which is accommodated by the slide guide by means of a parallel control arm arrangement. Between the parallel control arm arrangement and the clamping plate there is a compression spring which exerts a clamping force on the book block, wherein the clamping force of increases with increasing spring action from a defined pretensioning force to the maximum force. The contact pressure on the outer clamping jaw that is freely slidable on the guide is exerted by a closing cam that is installed on the side of the movement path of the circulating book block clamp, wherein a cam roller of the slide guide of the outer clamping jaw contacts the closing cam. The distance between the closing cam and the inner clamping jaw can be set in accordance with the book block thickness or the desired clamping force to be exerted. In order to maintain the clamping force exerted on the book block by the closing cam and the compression spring when the book block clamp leaves the region of the closing cam, the slide guide comprises a self-locking cam locking mechanism which when an outward-acting force is experienced locks the outer clamping jaw.

In known book block processing machines comprising parallel-closing book block clamps the respective book block, positioned on its spine, is fed to the opened book block clamp diagonally from below. In this arrangement, the book block is advanced by a pusher of a transport chain right up to a horizontal tabletop, while it is laterally guided by the inner and outer clamping jaws of the book block clamp. Finally the book block is aligned by resting its rear edge against a book stop catch of the book block clamp and is then clamped by the book block clamp.

For functionally secure lateral guidance of unbound book blocks comprising a multitude of layers and/or single sheets, the opening stroke of the book block clamp is to be limited to a minimum. However, due to fixed cam geometries for controlling the opening and/or closing movement, only a maximum opening stroke is provided, which is designed for a book block with voluminous paper and maximum block thickness. To reduce the opening stroke, only part of the stroke of the respective cam is used, wherein the cam roller encounters a rising cam flank, thus producing a corresponding jerk or jolt in the opening- and/or closing movement. Book block processing machines are known in which the book block clamps are always operated with the full cam stroke, wherein the cam roller contacts the cam without jerking or jolting. However, the resulting opening width in the case of thin book blocks is too wide to provide reliable guidance during infeed to the book block clamp, in particular when unstable layers and/or single sheets of an unbound book block are involved.

SUMMARY OF THE INVENTION

It is thus the object of the present invention to improve a book block clamp for clamping and transporting book blocks in book block processing machines whereby its opening width, with a view to reliable and impeccable lateral guidance, is adjustable to the non-clamped thickness of the fed-in book block, and in that its opening- and/or closing movement is generated without any jerking or jolting.

The inventive concept is based on a support element being associated with the outer clamping jaw of the book block clamp, which support element can be moved by control means into a position that is spaced apart in parallel in relation to the outer clamping jaw, as a result of which the opening width of the book block clamp is reduced, while the distance between the inner and the outer clamping jaws remains unchanged. By separately controlling the opening width, reliable and impeccable guidance, in particular of unstable layers and/or folded sections of unbound book blocks, becomes possible, while the opening-and/or closing movement of the outer clamping jaw continues to be controlled by way of a fixed greater actuating stroke.

Preferably, the reduction in the opening width of the book block clamp takes place in the infeed area of the book block processing machine, at a point in time when at least one block corner of the fed-in book block is between the open clamping jaws of the book block clamp. Thus for inserting the corner of the block the book block clamp is wide open, while its opening width during the remaining time of infeeding is set according to the non-clamped block thickness for secure lateral guidance of the layers and/or single sheets. It is expedient that the support element is pushed against the outer clamping jaw by a spring that is supported by the outer clamping jaw. In this way the support element rests against the outer clamping jaw without the action of the control means, for example for exerting a clamping force from the outer clamping jaw, which clamping force acts directly onto the book block.

Preferably, the control means is a control cam that acts on a cam roller of the support element. The opening width for feed-in of the book block is set by way of the distance between the control cam and the inner clamping jaw. In a simple manner setting the opening width can also be achieved in that the control cam is connected to an opening or closing cam on the outer clamping jaw, wherein the distance between the control cam and the respective opening or closing cam is adjustable. The additional opening dimension of the book block clamp in relation to the set block thickness is quasi set during feed-in of the book block. Reducing the opening width takes place depending on the difference between the clamped and the non-clamped block thickness. In the case of thick book blocks only a small reduction in the opening width defined by the opening or closing cam is required, while in the case of thin book blocks a significant reduction takes place. By means of the slidability of the control cam along the direction of conveying the book block clamps, adjustment of the point in time of reducing the opening width is achieved in a simple way. An advantageous improvement provides for the control cam to have an infeed section with a cam stroke that is changeable and that can be set to the extent of the reduction in the opening width. In this way the cam roller of the support element moves to the control cam without jerking or jolting. To this effect the infeed section can be made from an elastic girder that is firmly connected to the control cam, wherein the girder on its end is accommodated by a feeding device of the opening or closing cam. This obviates the need for any further separate adjustment.

In order to compensate for fluctuations in product thickness, both in block height and in block width, the outer clamping jaw is guided so that within certain limits it can be tilted towards the inner clamping jaw. To allow the support element to follow these tilt movements the support element is expediently elastic, wherein it comprises a stiffener in longitudinal direction. For the same reason it is advantageous if the support element comprises several pins, aligned perpendicularly in relation to the support surface and guided in spherical bearings on the outer clamping jaw, wherein a centrally arranged guide rod is guided in a linear way. Preferably, at the end of this centrally arranged guide rod the above-mentioned cam roller of the support element is arranged.

BRIEF DESCRIPTION OF THE DRAWING

One embodiment of the book block clamp according to the invention is described below with reference to the drawing, wherein.

DESCRIPTION OF THE PREFERRED EMBODIMENT

Figure 1:
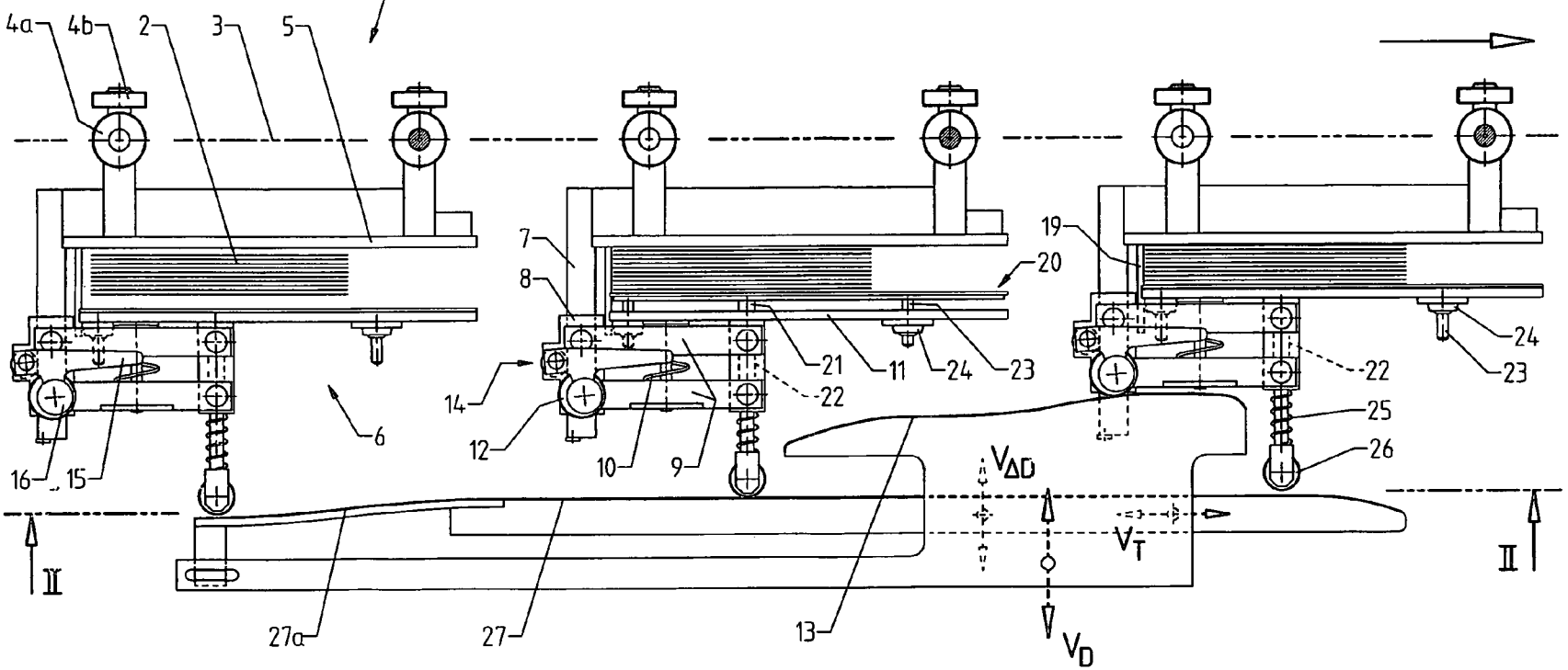
FIG. 1 is a top view of an infeed area of a book block processing machine comprising three consecutive book block clamps.

The book block processing machine comprises a transport system that includes a multitude of book block clamps 1 that are continuously movable in a closed circulation path and that are arranged at equal mutual spacing from each other. The book block clamps 1 move in a guideway and are connected to a transport chain 3 that provides the driving force. The book block clamps 1 comprise an inner clamping jaw 5 with horizontal and vertical guide rollers 4*a* and 4*b* and an outer clamping jaw 6 which is arranged parallel to, and movable in relation to, the inner clamping jaw 5, wherein book blocks 2 are clamped by exerting a clamping force between the two clamping jaws 5 and 6.

By way of a slide guide 8, the outer clamping jaw 6 is guided so as to be freely slidable on a guide rod 7 that is located on one side of the inner clamping jaw 5. The outer clamping jaw 6 itself comprises a clamping plate 11, which is accommodated by the slide guide 8 by means of a parallel control arm arrangement 9. Between the parallel control arm arrangement 9 and the clamping plate 11 there is a compression spring 10 which exerts a clamping force on the book block 2, which increases with increasing spring action from a defined pretensioning force to the maximum force. The contact pressure on the outer clamping jaw 6 that is freely slidable on the guide rod 7 is exerted by a closing cam 13 that is installed on the side of the movement path of the circulating book block clamp 1, wherein a cam roller 12 of the slide guide 8 of the outer clamping jaw 6 contacts the closing cam 13. The distance between the closing cam 13 and the inner clamping plate 5 can be set in accordance with the book block thickness or the desired clamping force to be exerted. The corresponding adjustment is shown in FIG. 1 by a dashed double arrow $V_D$. To ensure a closing movement without any jerking or jolting, the outer clamping jaw 6 is always open far enough for the cam roller 12 to tangentially contact the closing cam 13. In this way the outer clamping jaw 6 always performs the intended full cam lift on the closing cam 13.

In order to maintain the clamping force exerted on the book block 2 by the closing cam 13 and the compression spring 10 when the book block clamp 1 leaves the region of the closing cam, the slide guide 8 comprises a self-locking cam locking mechanism 14 which when an outward-acting force is experienced locks the outer clamping jaw 6. Unlocking the cam locking mechanism 14 for sliding the outer clamping jaw 6 outward and thus for opening the book block clamp 1 is performed by manual or automatic outward operation of a lever 15 that is connected to the cam locking mechanism 14. On the lever 15 there is a cam roller 16 which, in the delivery region of the book block processing machine, is brought into effective interaction with an opening cam.

Figure 2:
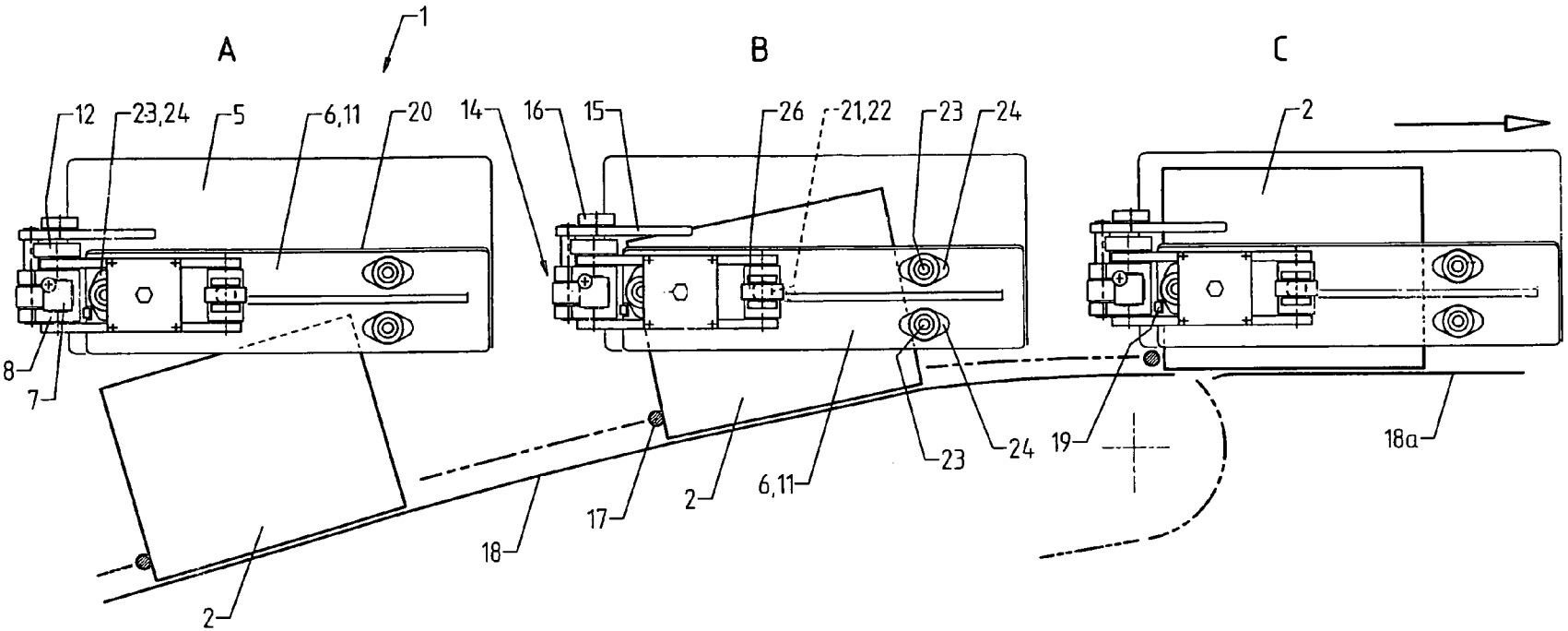
FIG. 2 is a lateral view of the book block clamps according to the view definition II-II in FIG. 1.

FIGS. 1 and 2 show the three essential movement phases in the infeed section where the book blocks 2 enter and are captured by the book block clamps 1. In the receiving phase A feeders 17 transport the book blocks 2 from below for receipt between the open clamping jaws 5 and 6 by way of an inclined ramp 18. In the guide phase B the book blocks 2 are advanced to a horizontal table 18 *a*, wherein the book blocks 2 are laterally guided between the clamping jaws 5 and 6. The clamping phase C commences when the rear edge of the book block 2 is aligned on a book stop catch 19 of the book block clamp 1. When the clamp is closed, the clamped book block is transported onward toward a work station.

According to the invention a support element 20 is associated with the outer clamping jaw 6. The support element 20 can be moved into a position that is spaced apart in parallel in relation to the outer clamping jaw 6, as a result of which the opening width of the book block clamp 1 is reduced, while the distance between the inner and the outer clamping jaw 5 and 6 remains unchanged in order to achieve smooth contact against the closing cam 13. In the receiving phase A the support element 20 rests against the clamping element 11 of the outer clamping jaw 6. The front edge of the book block 2 is placed without hindrance into the wide-open book block clamp 1. In the guide phase B the support element 20 is moved from the outer clamping jaw 6 towards the inside for the purpose of reducing the opening width to a dimension that matches the thickness of the non-clamped blocks so that in particular unstable layers and/or single sheets of an unbound book block 2 are reliably guided. In the clamping phase C the book block 2 is pushed, by way of the support element 20, from the outer clamping jaw 6 towards the inner clamping jaw 5. In this process the support element 20 rests against the clamping plate 11 of the outer clamping jaw 6.

Figure 3:
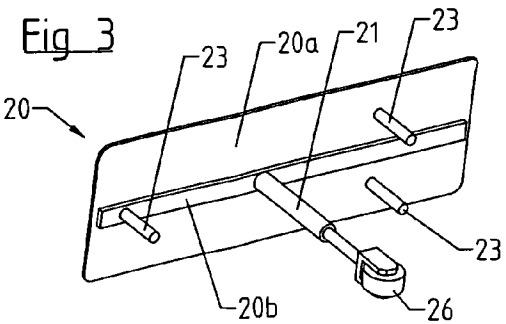
FIG. 3 is a separate perspective view of the support element according to the invention.

According to FIG. 3 the support element 20 comprises an elastic plate 20*a* with a longitudinally aligned stiffener 20*b* on its side facing away from the book block 2. A guide rod 21 is arranged on the stiffener 20*b*, wherein it is guided in a linear guide 22 of the outer clamping jaw 6 so as to be freely slidable. Additional pins 23 that are aligned so as to be perpendicular in relation to the support surface are guided in spherical articulated bearings 24. Due to this bearing arrangement and the elasticity of the plate 20 a the support element 20 can follow the tilt movements of the outer clamping jaw 6, which the jaw 6 carries out during clamping of the book blocks 2 in order to compensate for fluctuations in product thickness.

The support element 20 is pushed against the outer clamping jaw 6 by means of a compression spring 25. The compression spring 25 is seated on the extended end of the guide rod 21 and is supported between a shoulder of the guide rod 21 and the outer clamping jaw 6. At the end of the guide rod 21 a cam roller 26 is rotatably held, wherein it can be brought into effective connection with a control cam 27. Without the effect of the control cam 27 the support element 20 rests against the outer clamping jaw 6 (compare infeed phase A), while as a result of the cam roller 26 contacting the control cam 27 the support element is moved to a position that is parallel to, and spaced apart from, the outer clamping jaw 6 (compare guide phase B). In the clamping phase C the outer clamping jaw 6 is pushed against the book block 2 to be clamped. In this phase the support element 20 remains at the set distance from the inner clamping jaw 5 until it rests against the outer clamping jaw 6 or its clamping plate 11 and, with the latter, is moved inward to clamp the book block 2. In this phase the cam roller 26 is lifted from the control cam 27.

By way of the distance between the control cam 27 and the inner clamping jaw 5 the opening width for feeding in the book blocks 2 is adjusted. In the embodiment shown the control cam 27 is connected to the closing cam 13 of the outer clamping jaw 6, wherein the distance between the control cam 27 and the closing cam 13 is adjustable. In FIG. 1 this relative adjustment $V_{\Delta D}$ of the opening width is indicated by a dashed double arrow. The additional opening dimension of the book block clamp 1 in relation to the set block thickness is quasi set during feed-in of the book block 2. Reducing the opening width takes place depending on the difference between the clamped and the non-clamped block thickness. In the case of thick book blocks only a small reduction in the opening width defined by the closing cam 13 is required, while in the case of thin book blocks a significant reduction takes place in that the adjustment $V_{\Delta D}$ results in the relative distance between the control cam 27 and the closing cam 13 being reduced and the support element 20 being moved inward by the control cam 27.

By means of the slidability of the control cam 27 along the direction of conveying the book block clamps 1, adjustment $V_T$ of the point in time of reducing the opening width is achieved in a simple way. The reduction in the opening width can be initiated as soon as a front edge of the book block 2 has been fed between the two clamping jaws 5 and 6. Adjustment $V_T$ thus takes place depending on the book block format by way of height and width. The control cam 27 comprises an infeed section 27*a* with an adjustable cam stroke that can be set to the dimension of the reduction in opening width. The infeed section 27*a* comprises an elastic girder that is firmly connected to the control cam 27. The end of the elastic girder is connected to a feeding device of the closing cam 13. The bending line of the girder, which is variable by changing the stroke, determines the cam contour, which as a result of this is free of any jerking or jolting and makes it possible for the cam roller 26 to tangentially contact the infeed section 27*a* of the control cam 27.

The invention claimed is:

1. A book block clamp for clamping and transporting book blocks along a conveying direction in a book block processing machine having an infeed portion in which book blocks are received, guided and clamped, comprising:

an inner clamping jaw;

an outer clamping jaw which is arranged parallel to, and movable toward and away from, said inner clamping jaw;

an actuation system for opening and closing the clamping jaws, whereby the outer clamping jaw is initially laterally spaced from the inner clamping jaw to establish an opening width for receiving the book block during a receiving phase and then moved toward the inner clamping jaw to exert a clamping force on the received book block during a clamping phase;

a support element located between the inner and outer clamping jaws and operatively associated with the outer clamping jaw; and a controller operatively associated with the support element for moving the support element into a position that is in spaced apart, parallel relation to the outer clamping jaw, to reduce the width of said opening and thereby contact and guide the received book block laterally before the book is clamped, during a guide phase between the receiving phase and the clamping phase.

2. The book block clamp according to claim 1, wherein at the feed phase of the book block processing machine the support element for reducing the opening width is controlled to move to a position that is spaced apart in parallel to the outer clamping jaw after a corner of a moving infed book block enters between the open clamping jaws of the book block clamp.

3. The book block clamp according to claim 2, wherein the support element is biased against the outer clamping jaw by a spring that is supported by the outer clamping jaw.

4. The book block clamp according to claim 3, wherein the controller reduces the width of the opening of book block clamp while guiding the book block between the inner and outer clamping jaws.

5. The book block clamp according to claim 2, wherein the controller includes a control cam acting on a cam roller of the support element at a distance from the inner clamping jaw, and the distance between the control cam and the inner clamping jaw is adjustable.

6. The book block clamp according to claim 5, wherein the actuation system includes an opening or closing cam of the outer clamping jaw, and the control cam is connected to the opening or closing cam whereby the distance between the control cam and the corresponding opening- or closing cam is adjustable ($V_{\Delta D}$).

7. The book block clamp according to claim 6, wherein the control cam comprises a cam infeed section which is made from an elastic girder that is firmly connected to the control cam, and said girder has one end accommodated by a feeding device of the opening or closing cam.

8. The book block clamp according to claim 5, wherein the control cam is slidably resettable along the direction of conveyance to adjust ($V_T$) the point in time of the reduction in opening width.

9. The book block clamp according claim 5, wherein the control cam comprises an cam infeed section with a cam stroke that is changeable and that can be set to the extent of the reduction in the opening width.

10. The book block clamp according to claim 1, wherein the support element is biased against the outer clamping jaw by a spring that is supported by the outer clamping jaw.

11. The book block clamp according to claim 10, wherein the controller includes a control cam acting on a cam roller of the support element at a distance from the inner clamping jaw, and the distance between the control cam and the inner clamping jaw is adjustable.

12. The book block clamp according to claim 11, wherein the actuation system includes an opening or closing cam of the outer clamping jaw, and the control cam is connected to the opening or closing cam whereby the distance between the control cam and the corresponding opening or closing cam is adjustable ($V_{\Delta D}$).

13. The book block clamp according to claim 12, wherein the support element for reducing the opening width is controlled to move to a position that is spaced apart in parallel to the outer clamping jaw after a corner of a moving infed book block enters between the open clamping jaws of the book block clamp.

14. The book block clamp according to claim 11, wherein the controller reduces the width of the opening of the book block clamp while guiding the book block between the inner and outer clamping jaws.

15. The book block clamp according to claim 1, wherein the support element is elastic and includes a stiffener elongated in the conveying direction.

16. The book block clamp according to claim 1, wherein the support element has a substantially planar support surface facing the inner clamping jaw and a back surface facing the outer clamping jaw, said back surface having several pins projecting perpendicularly in relation to the support surface and guided in spherical bearings on the outer clamping jaw, and a centrally arranged guide rod projecting perpendicularly in relation to the support surface and mounted for linear displacement through the outer clamping jaw.

17. The book block clamp according to claim 1, wherein the controller includes a control cam acting on a cam roller of the support element at a distance from the inner clamping jaw, the support element has a substantially planar support surface facing the inner clamping jaw and a back surface facing the outer clamping jaw, said back surface having several pins projecting perpendicularly in relation to the support surface and guided in spherical bearings on the outer clamping jaw, and a centrally arranged guide rod projecting perpendicularly in relation to the support surface and mounted for linear displacement through the outer clamping jaw, and the cam roller is arranged at the end of the centrally arranged guide rod.

18. The book block clamp according to claim 1, wherein the controller reduces the width of the opening of the book block clamp while guiding the book block between the inner and outer clamping jaws.

19. The book block clamp according to claim 18, wherein the support element is biased against the outer clamping jaw by a spring that is supported by the outer clamping jaw.

20. The book block clamp according to claim 19, wherein the controller includes a control cam acting on a cam roller of the support element at a distance from the inner clamping jaw, and the distance between the control cam and the inner clamping jaw is adjustable.

21. A book block clamp for clamping and transporting book blocks along a conveying direction in a book block processing machine having an infeed portion in which book blocks are received, guided and clamped, comprising:

an inner clamping jaw;

an outer clamping jaw including a clamping plate which is arranged parallel to, and movable toward and away from, said inner clamping jaw;

an actuation system for opening and closing the clamping jaws, whereby the clamping plate is initially laterally spaced from the inner clamping jaw to establish an opening width for receiving the book block during a receiving phase and then moved toward the inner clamping jaw to exert a clamping force on the received book block during a clamping phase;

a support element located between the clamping plate and the inner clamping jaw, in parallel with the clamping plate and operatively associated with the outer clamping jaw; and a controller operatively associated with the support element for moving the support element into a position that is in spaced apart, parallel relation to the clamping plate, to reduce the width of said opening and thereby guide the received book block laterally during a guide phase between the receiving phase and the clamping phase.

* * * * *